US008925217B2

(12) United States Patent
Wiens et al.

(10) Patent No.: US 8,925,217 B2
(45) Date of Patent: Jan. 6, 2015

(54) DEVICE AND METHOD FOR DRYING A TISSUE PAPER WEB WITH STEAM RECAPTURE

(75) Inventors: Martin Wiens, Heidelberg (DE); Bruno Dexler, Burstadt (DE); Jan Hieke, Weinheim (DE); Josef Heintz, Kirrweiler (DE)

(73) Assignee: SCA Hygiene Products AB, Gothenburg (SE)

( * ) Notice: Subject to any disclaimer, the term of this patent is extended or adjusted under 35 U.S.C. 154(b) by 830 days.

(21) Appl. No.: 13/146,958

(22) PCT Filed: Dec. 22, 2009

(86) PCT No.: PCT/EP2009/067753

§ 371 (c)(1),
(2), (4) Date: Jul. 29, 2011

(87) PCT Pub. No.: WO2010/091765

PCT Pub. Date: Aug. 19, 2010

(65) Prior Publication Data

US 2011/0277340 A1 Nov. 17, 2011

(30) Foreign Application Priority Data

Feb. 11, 2009 (DE) ..... 10 2009 000 756

(51) Int. Cl.

| | |
|---|---|
| ***F26B 3/00*** | (2006.01) |
| ***F26B 9/00*** | (2006.01) |
| ***D21F 5/02*** | (2006.01) |
| ***D21F 5/20*** | (2006.01) |

(52) U.S. Cl.

CPC ... *D21F 5/02* (2013.01); *D21F 5/20* (2013.01)
USPC ..... 34/470; 34/421; 34/425; 34/449; 34/477; 34/114; 34/119; 34/124

(58) Field of Classification Search

USPC ..... 34/114, 119, 124, 418–422, 425, 444, 34/448, 449, 470, 477
See application file for complete search history.

(56) References Cited

U.S. PATENT DOCUMENTS

| | | | | |
|---|---|---|---|---|
| 4,615,122 | A * | 10/1986 | Sherrod et al. | 34/422 |
| 2008/0189981 | A1 | 8/2008 | Munch | |

FOREIGN PATENT DOCUMENTS

| | | | |
|---|---|---|---|
| DE | 3319348 | A1 | 12/1983 |
| DE | 35 01 584 | A1 | 8/1985 |
| DE | 4304244 | A1 | 8/1993 |
| DE | 10 2007 006 960 | A1 | 8/2008 |
| EP | 0 294 982 | A2 | 12/1988 |
| EP | 0 905 311 | A2 | 3/1999 |
| EP | 1 027 495 | B1 | 4/2004 |

OTHER PUBLICATIONS

International Search Report, dated Apr. 6, 2010, from corresponding PCT application.

* cited by examiner

*Primary Examiner* — Jiping Lu
(74) *Attorney, Agent, or Firm* — Drinker Biddle & Reath LLP

(57) ABSTRACT

Method for steam recapture in the drying of a tissue paper web with a cylinder that is fed from a live steam network and with a hot air hood that flows hot air onto the tissue paper web, includes the steps of: removing condensate from the cylinder; compressing the condensate to a first pressure level essentially corresponding to that of the live steam network; heating the condensate by heat exchange with the exhaust air from the hot air hood; vaporizing the condensate; and feeding generated steam into the live steam network.

15 Claims, 2 Drawing Sheets

DEVICE AND METHOD FOR DRYING A TISSUE PAPER WEB WITH STEAM RECAPTURE

Figure 1:
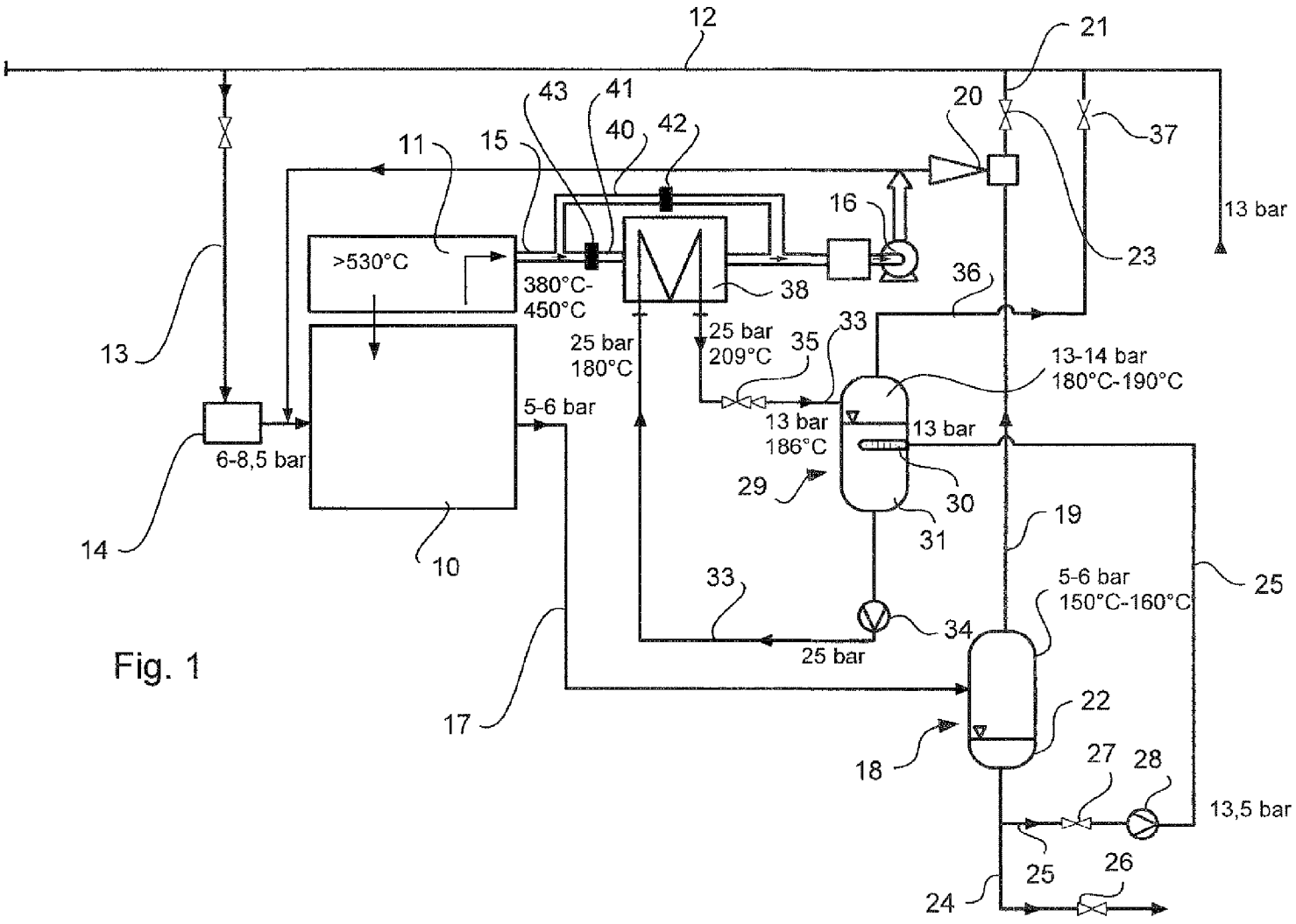

This invention relates to tissue paper production and especially a device for drying a tissue paper web with a heatable cylinder, the so-called Yankee or crepe cylinder, to which, for its heating, steam from a live steam network is supplied, as well as a hot air hood on the outer periphery of the cylinder in order to blow hot air onto the tissue paper web and to exhaust the air, the tissue paper web being dried by both the hot outer surface of the cylinder and also the hot air. The water that is vaporized in doing so is exhausted and disposed of by way of the exhaust air of the hot air hood. Furthermore, this invention relates to a method for steam recapture in the drying of a tissue paper web with such a device.

Here, tissue paper is to be defined as a soft absorbing paper with a low surface weight. Generally, a surface weight of 8 to 40 g/m$^2$, especially 10 to 25 g/m$^2$, per layer is chosen. The entire base weight of a multilayer tissue product is preferably up to a maximum of 120 g/m$^2$, especially preferably up to a maximum of 60 g/m$^2$. Its density is typically below 0.6 g/cm$^3$, preferably below 0.30 g/cm$^3$, and more preferably between 0.08 and 0.20 g/cm$^3$.

The production of tissue paper differs from paper manufacture by the extremely low surface weight and the much higher tensile stretching strain characteristic (see DIN EN 12625-4 and DIN EN 12625-5). Paper and tissue paper furthermore differ generally with respect to the modulus of elasticity that characterizes the stress-strain properties of these planar products as material parameters.

The high tensile stretching strain characteristic comes from the outer or inner creping of the tissue. The initially mentioned creping is carried out by compression of the paper web on a dry cylinder as a result of the action of a crepe scraper or, in the case of the last-mentioned creping, as a result of a speed difference between two sieves ("substances"). This results in that the ever-moist, plastically deformable paper web is broken open internally by compression and shearing, as a result of which it becomes stretchable under load as uncreped paper.

Wet tissue paper webs are conventionally dried by the so-called Yankee drying, aeration drying (TAD), or the pulse drying method.

The fibers contained in the tissue paper are mainly cellulose fibers such as, for example, fibers of chemical fibrous material (for example, kraft sulfite and sulfate cellulose), mechanical fibrous material (for example, ground wood), thermomechanical fibrous material, chemomechanical fibrous material and/or chemo-thermomechanical fibrous material (CTMP). Fibrous materials that are formed from deciduous wood (hardwood), from conifer wood (soft wood), or from annuals can be used. The fibers can also be recycled fibers or can contain the latter. The fibers can be treated with additives—for example, fillers, softeners, such as for example, quaternary ammonium compounds and binders, such as, for example, conventional dry compaction agents or wet compaction agents, which are used to facilitate the original paper forming and are used for adjusting the properties thereof. The tissue paper can also contain other fiber types, for example regenerated cellose fibers or plastic fibers that, among others, increase the strength, the absorption capacity, the smoothness or the softness of the tissue paper.

The use of a steam-heated cylinder and a hot air hood by means of which hot air is blown onto the tissue web that is running around the heated cylinder is known in the prior art, for example, from DE 10 2007 006 960 A1, EP 294 982 B1 or EP 1 027 495 B1.

As a result of the increasing energy costs that are also reflected in the costs for steam removal from the live steam network, there are efforts to the effect of reducing the required amount of steam and thus the energy costs that are necessary for paper production.

The object of this invention is consequently to provide a device for drying a tissue paper web and a method for steam recapture in the drying of a tissue paper web that make it possible to reduce the required amount of steam for drying the tissue paper web from a live steam network in a stable control circuit, especially to reduce the costs that arise in paper production and especially drying.

The invention is based on the idea of using the exhaust air from the hot air hood that has already been used for drying the tissue paper web but that has a high residual energy content in order to again vaporize condensate from the heatable cylinder and to feed the steam produced in doing so at a higher pressure level back into the live steam network. In this way, in the final effect, less steam is required from the live steam network, as a result of which the energy costs and thus the production costs for the tissue paper web can be reduced. Moreover, a live steam network is a large buffer in such a way that a stable control circuit with the associated stable drying and thus stable paper quality can be achieved.

Accordingly, the device for drying a tissue paper web comprises a heatable cylinder, the so-called Yankee or crepe cylinder. The cylinder for heating with steam is connected to a supply line that supplies the steam and that can be connected to a live steam network. A live steam network for the purposes of this invention is defined as any network that makes available live steam and that supplies at least two consumers with live steam at a first pressure level. In this case, one of the consumers is the heatable cylinder of a tissue paper machine. The other consumer can likewise be, for example, a heatable cylinder, but of another tissue paper machine. Other consumers are also conceivable, however. The condensate that forms during drying in the cylinder is removed from the cylinder via a condensate line. Moreover, the device comprises a hot air hood on the outer periphery of the cylinder in order to blow hot air in the direction of the outer periphery and thus in operation onto the tissue paper web that is running around the heatable cylinder. Thus, the tissue paper web, on the one hand, is dried by the hot outer periphery of the heatable cylinder, and, on the other hand, by the hot air of the hot air hood that has been blown onto the tissue paper web. After the hot air of the hot air hood has been used for drying the tissue paper, it is removed with the vaporized water via an exhaust air line from the hot air hood. The device according to the invention furthermore comprises a first pressure stage that is made to compress condensate from the cylinder to the first pressure level of the Yankee cylinder. In this case, the pressure level achieved there can deviate from the first pressure level by ±2-7 bar. Furthermore, in the device according to the invention, there is a vaporization means for at least partial vaporization of the condensate with an energy transfer means. The energy transfer means is made to transfer energy of the exhaust air in the exhaust air line to the condensate. The energy transfer can be adversely affected by the occurrence of steam bubbles in the condensate, in such a way that the energy transfer according to the invention takes place downstream from the first pressure stages. The pressure rise increases the boiling point of the condensate (water) and thus prevents the occurrence of steam bubbles in the heat exchanger. Finally, the device of this invention comprises a backfeed line that can be connected to the live steam network in order to feed the steam generated from the condensate back into the live steam network. The configuration according to the invention uses the exhaust air from the hot air hood or its energy for steam generation from the condensate that has been removed from the cylinder in such a way that less live steam from a live steam network is needed, as a result of which the energy and live steam costs can be cut. Furthermore, the live steam network forms a relatively large buffer in order to provide a stable control circuit that is necessary to achieve a constant temperature of the heatable cylinder with the associated constant drying quality and paper quality.

In order to further improve the heat transfer between the exhaust air from the hot air hood and the condensate (water) and to further reduce the occurrence of steam bubbles in the condensate, it is preferable to provide a second pressure stage that is configured to compress the condensate from the essentially first pressure level to a second higher pressure level. Here, the boiling point is further raised, as a result of which possible steam bubbles condense in the condensate and the occurrence of steam bubbles is essentially precluded. The energy transfer means is consequently connected downstream from the second pressure stage and is more preferably formed by a heat exchanger located in the exhaust air, especially a tube heat exchanger. The condensate that has been compressed to the second pressure level is heated via the heat exchanger.

Finally, it is further preferred to provide a third pressure stage that is made to suddenly and abruptly vaporize the heated condensate, for which the condensate is expanded from the second pressure level to the first pressure level; i.e., vaporization occurs primarily in that the pressure level of the condensate heated beforehand is reduced in such a way that the boiling point suddenly drops and is thus exceeded, and a phase transition from liquid to gaseous occurs. Moreover, the expansion in this respect is intended to bring the generated steam to the pressure level of the live steam network in order to enable backfeed via the backfeed line.

Furthermore, it is preferred according to the invention—especially to achieve optimum separation of steam/condensate and to be able to build a control circuit—that the device furthermore comprises a first condensate separator that is connected to the condensate line and a first return line that is connected to the first condensate separator. Here, the first pressure stage is formed by a first pump in the first return line. Furthermore, there is a second condensate separator that is connected to the first return line. As becomes clear below, the temperature in the second condensate separator is much higher than the temperature in the first condensate separator and thus the condensate that is fed into the second condensate separator via the first return line. To equalize this temperature difference, the condensate is preferably delivered to the second condensate separator via a diffuser. Furthermore there is a second return line that is connected to the second condensate separator. In this connection, the second pressure stage is formed by a second pump in the second return line, and the heat exchanger connected downstream from the second pump is integrated into the second return line. The third pressure stage according to this embodiment is preferably formed by an expansion means located downstream from the heat exchanger, in the form of an expansion valve or a capillary or throttle in the second return line. Furthermore, the second return line connected downstream from the expansion means is connected to the second condensate separator. The generated steam is fed back likewise from the second condensate separator, for which the backfeed line is connected to the latter.

Depending on the initial temperature of the condensate and the temperature of the exhaust air that flows through the heat exchanger, the second pressure level is preferably in a range of 23-27 bar, preferably in a range of 24-26 bar, and most preferably 25 bar. This pressure range is chosen in such a way that in the passage through the heat exchanger, depending on the transmitted heat to the condensate, the boiling point is not exceeded and thus steam is not generated. According to the preferred embodiment, it will only be generated by the expansion in the third pressure stage.

The first pressure level, depending on the pressure of the live steam network, is in a range of 10-15 bar, preferably 13-14 bar, and most preferably 13 bar.

Alternatively to the configuration of the energy transfer means in the form of a heat exchanger integrated into the second return line, it is also conceivable that the energy transfer means comprises a condensate separator through which the exhaust air line runs preferably with a large surface in such a way that the heat transfer from the exhaust air is transferred to the condensate in the condensate separator, as a result of which the condensate vaporizes in the condensate separator. In this embodiment, the steam generated in the condensate separator is likewise returned into the live steam network via the backfeed line. Here, however, the problem is that in this case, the condensate separator with its large dimensions and its high weight must be located in a high position, i.e., above the paper machine. This can lead to problems mechanically and in terms of construction engineering. The advantage of this configuration is, however, that pumps and valves can be eliminated.

In order to achieve a relatively high heat transfer for vaporization and thus to provide an effective system, it is especially preferable to use high-temperature hoods as hot air hoods, as are described in, for example, EP 0 905 311 A2. Such hot air hoods are made to blow hot air with a temperature of more than 530° C. onto the tissue paper web. At most, roughly 650° C. is achieved at present. The exhaust air of such a high-temperature hood depending on the application has a temperature of roughly 150° C. less than the hot air and is thus at most 500° C.

In addition to the device according to the invention, a method is also proposed for steam recapture in the drying of a tissue paper web with a cylinder that is fed from a live steam network and with a hot air hood; the hot air flows onto the tissue paper web. The method according to the invention comprises the steps of removal of the condensate from the cylinder, compression of the condensate to a first pressure level according to that of the live steam network, heating the condensate by heat exchange with the exhaust air from the hot air hood, vaporization of the condensate, and feed of the generated steam into the live steam network.

In correspondence with the device, it is preferred to compress the condensate to a second higher pressure level after compression to the pressure level and before heating the condensate with exhaust air from the hot air hood, as a result of which the boiling point of the condensate (water) is raised and thus the occurrence of steam bubbles is reduced. In this way, a better heat transfer becomes possible. Furthermore, it is preferred that the condensate in the heat transfer from the exhaust air to the condensate does not vaporize, i.e., the pressure level is chosen to be sufficiently high, and vaporization takes place only after the condensate is heated with exhaust air from the hot air hood by depressurization to the first pressure level.

The pressure ranges of the second and first pressure level correspond to the aforementioned pressure ranges, in the same way the exhaust air more preferably has a temperature of more than 350° C.

Figure 2:
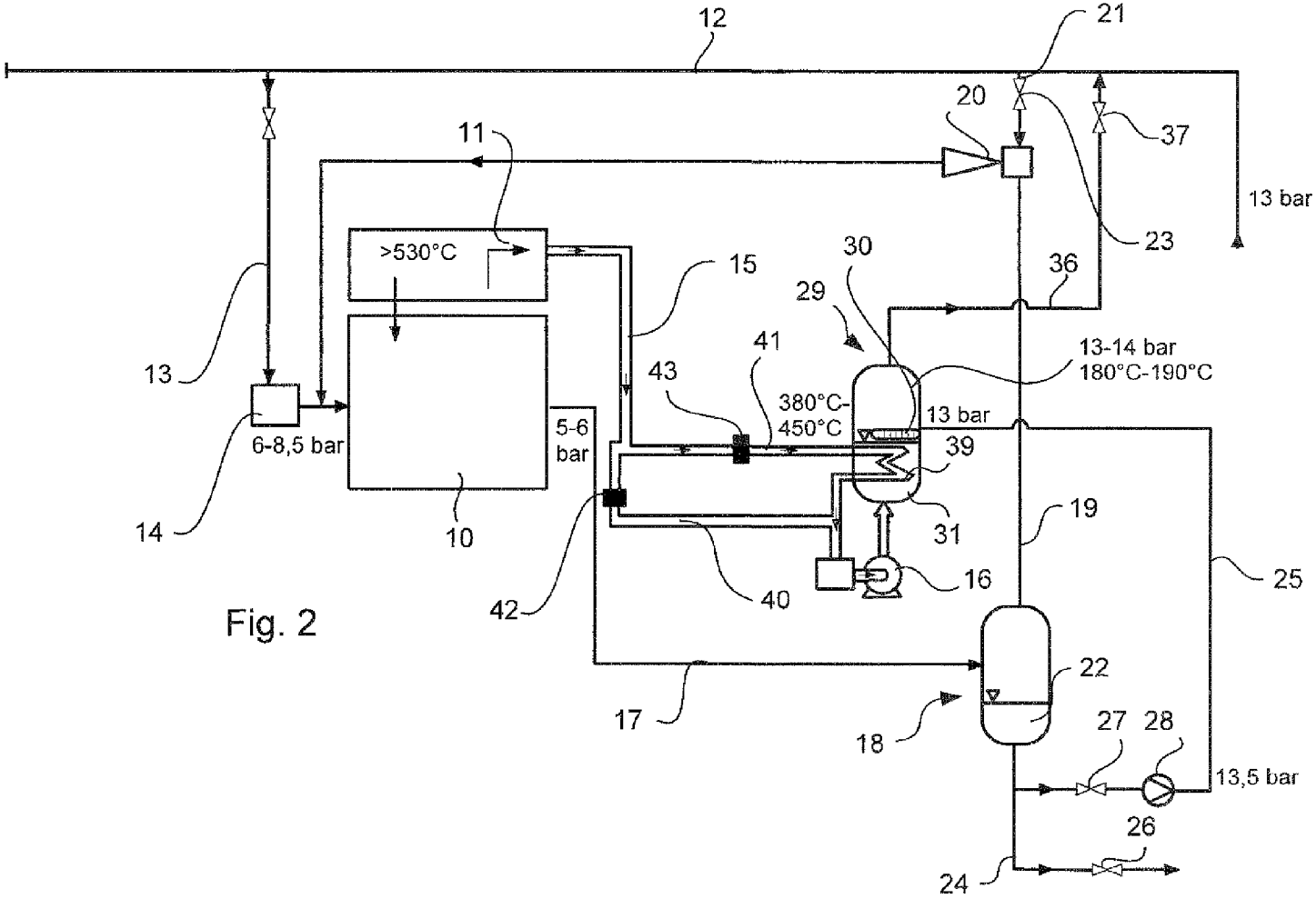

In addition to the aforementioned features that, unless contradicting one another, can be used individually and independently of one another or in any combination, other individual features that can be combined with one or more of the aforementioned features are apparent from the following description of one preferred embodiment. This description is made with reference to the accompanying drawings, in which:

FIG. 1 shows a diagram of a device according to the invention in a first embodiment; and FIG. 2 shows a diagram of a device according to the invention in a second embodiment.

FIG. 1 does not show the components of the tissue paper machine with the exception of the steam-heatable Yankee cylinder 10 and the pertinent high-temperature hot air hood 11. The hot air hood 11 can be, for example, a hot air hood according to EP 0 905 311 A2. Furthermore, a live steam network line 12 is shown that is intended to represent the live steam network from which the Yankee cylinder 10 is supplied with steam. In this case, the live steam network 12 makes available live steam with a pressure of roughly 13 bar. The live steam network 12 and the Yankee cylinder 10 are connected to one another via a supply line 13. In the supply line 13, the pressure is reduced via an expansion means 14. The steam that is supplied to the Yankee cylinder 10 with a pressure of 6-8 bar heats the Yankee cylinder 10 in such a way that the tissue paper web (not shown) that is routed around the outer surface or a portion of the outer surface of the Yankee cylinder 10 is dried by heat conduction.

Along one partial region of the outer surface of the Yankee cylinder 10, there is, moreover, a so-called high-temperature hot air hood 11 that in the illustrated embodiment blows hot air in a temperature range of currently a maximum 650° C. onto the side opposite the outer surface of the Yankee cylinder 10 onto the tissue paper web, as a result of which it is dried by means of convection. After striking the tissue paper web, the hot air is discharged via exhaust air channels (not shown) of the hot air hood 11, for which a fan 16 is located at the end of the exhaust air line 15. The exhaust air is tapped by way of an exhaust air line 15 via a bypass 40 with a flap 42 in order to open or close the bypass, via the fan 16, for hot water production, for heating the machinery room in which the paper machine is located, for preheating fresh air or for further heat recovery measures by the fan 16. Alternatively and according to this invention, the exhaust air can flow via the exhaust air line 15 with the flap 43 opened via the line 41 through a heat exchanger 38 integrated into the exhaust air line 15 before it is supplied to the aforementioned heat recovery measures via the fan 16. The heat exchanger 38 can be a conventional tube heat exchanger.

When the Yankee cylinder 10 is heated, the steam condenses and the condensate that is in the region of the saturated steam temperature is discharged from the Yankee cylinder 10 in a pressure range of between roughly 5-6 bar. For this purpose, there is a condensate line 17. The condensate line 17 discharges into a first condensate separator 18 in which condensate is separated from steam. The upper region of the condensate separator 18 is furthermore connected via a line 19 to a thermocompressor 20 (jet pump) that can be fluid-connected via a line 21 and a valve 23 to the live steam network line 12. In this way, the steam that in the first condensate separator 18 is in a pressure range of between 5-6 bar and at a temperature of roughly 150° C. to 160° C. is taken in via the thermocompressor 20 and is supplied again to the Yankee cylinder 10 via the supply line 13. In the lower region of the first condensate separator 18, the condensate 22 (vapor water) collects, i.e., water that is essentially in the vicinity of the saturated steam temperature. The condensate is supplied to a collecting tank (not shown) via an expansion means (26). Moreover, the lower region of the first condensate separator 18 for removal of the condensate 22 is connected to a first return line 25. The condensate 22 can flow via a valve 27 in the first condensate separator 18 into the first return line 25. Downstream from the valve 27 is a first pump 28 (first pressure stage). The pump 28 leads to compression of the condensate 22 to a pressure of roughly 13.5 bar and conveys the condensate to a second condensate separator 29. At the inlet of the second condensate separator 29, the condensate has roughly a pressure of 13 bar and a temperature of between roughly 150° C. and 160° C. However, in the second condensate separator 29 (as described below), a temperature of roughly 180 to 190° C. prevails. As a result of the temperature difference between the added condensate and the medium in the second condensate separator 29, the condensate from the return line 25 is delivered to the second condensate separator 29 via a diffuser 30. In the lower section of the second condensate separator 29, essentially liquid condensate 31 collects. The lower region of the second condensate separator 29 is connected to a second return line 33. A second pump 34 (second pressure stage) is located downstream from the condensate separator 29. The second pump 34 compresses the condensate 31 from the second condensate separator 29 to a pressure of roughly 25 bar.

Downstream from the pump 34, the compressed condensate that is, for example, in a temperature range of roughly 180° C. to 190° C. flows through the heat exchanger 38. In doing so, the energy from the exhaust air in the exhaust air line 15 is transferred to the condensate in the return line 33, and the condensate is heated. Here, the pressure of the condensate is chosen to be high in such a way that when the condensate is heated, vaporization of the condensate and especially steam bubbles do not arise. Downstream from the heat exchanger 38, the condensate has roughly a temperature of 209° C. at a pressure of 25 bar. Furthermore, in the return line 33, downstream from the heat exchanger 38, there is an expansion valve 35. On the expansion valve 35, part of the condensate is expanded from 25 bar to roughly 13.5 bar, as a result of which the condensate suddenly vaporizes, and the temperature is reduced to the saturated steam temperature. In connection with the expansion valve 35 (expansion means), the second return line 33 discharges into the second condensate separator 29 preferably in an upper region thereof. In the region of the second condensate separator 29, there is consequently steam generated from the condensate in a pressure range of between 13-14 bar and at a temperature of roughly 180-190° C.

With the upper region of the second condensate separator 36, there is a backfeed line that is or can be fluid-connected via a valve 37 to the live steam network line 12. With the valve 37 opened, the generated steam from the second condensate separator 29 is fed back into the live steam network or live steam network line, the pressure of the steam corresponding roughly to the pressure of the live steam network.

The operation of the device according to the invention and thus the method according to the invention are explained below.

The water vapor that is condensed in the Yankee cylinder 10 and that is used to dry the tissue paper web (not shown) is removed in the form of vapor water (condensate) that is present around the saturated steam temperature from the Yankee cylinder 10 in a pressure range of between 5-6 bar via the condensate line 17. The condensate is supplied to a first condensate separator 18. There, a first separation between the steam phase and liquid phase takes place. The liquid water (condensate) 22 collects in the lower region of the first condensate tank 18 and with the valve 27 opened is compressed via the first return line 25 by the first pump 28 (first pressure stage) to roughly 13.5 bar and delivered to the second condensate separator 29. The condensate is then fed via a diffuser 30 into the second condensate separator 29, where again separation between the steam phase and liquid phase takes place. The liquid condensate 31 that collects in the lower region of the second condensate separator 29 is compressed via the valve 32 by the second pump 34 in the second return line 33 from the pressure prevailing in the second condensate separator 29 of between 13-14 bar to 25 bar and is routed with a temperature of roughly 180° C. into the heat exchanger 38. At the outlet of the heat exchanger 38, the condensate always has a pressure of 25 bar, but a much higher temperature of roughly 209° C. Here, the exhaust air of the hot air hood with a temperature of a maximum 500° C. flows through the heat exchanger 38 and in doing so heats the condensate from the initial temperature of 180° C. to roughly 209° C. The expansion means in the form of the expansion valve 35 reduces the pressure level of the heated condensate suddenly from 25 bar to 13.5 bar, as a result of which the temperature likewise drops to the saturated steam temperature. This pressure reduction suddenly vaporizes the condensate in such a way that the condensate passes into the vapor phase. The steam is removed via the return line 33 into the second condensate separator 29 and can be fed back from there via the backfeed line 36 with the valve 37 opened into the live steam network. The boiling point of the condensate is noticeably raised by the two pressure stages, especially the second pressure stage with a pressure increase to 25 bar, in such a way that steam bubbles that may otherwise be contained in the condensate are avoided. In this way, the heat transfer from the exhaust air to the condensate can be made more efficient in the heat exchanger 38. In this way, the energy content of the exhaust air can be used more efficiently.

The system according to the invention for a paper machine with steam consumption of between 7-9 tons per hour can possibly return 1-3 tons of steam per hour to the live steam network 12. In this way, the actual live steam demand from the network is reduced by 1-3 tons, as a result of which the costs for the live steam can be greatly (up to ⅓) reduced. Moreover, the backfeed into the live steam network is especially advantageous with respect to control engineering aspects since there are no demand fluctuations. The live steam network that makes available live steam in an amount of at least 20 tons forms a large buffer and can buffer the 1-3 tons that have been fed back without control-engineering problems. Thus, an oversupply of the Yankee cylinder with steam and thus an overly great temperature rise or fluctuations cannot occur. If the outer surface of the Yankee cylinder is too hot, the problem arises that due to the moisture content of the tissue paper web, steam bubbles can form and lift the paper off the Yankee cylinder. If the temperature profile on the Yankee cylinder varies by more than 10° C., major production problems can be expected. This results in quality fluctuations in the paper that are undesirable, but that form due to unstable drying. "Overheating or temperature fluctuations" of the Yankee cylinder with the aforementioned associated problems can be avoided by the device according to the invention and the corresponding method. The existing energy is fed back into the network and is thus removed first from the control circuit.

As another advantage, the amount of condensate that can be removed via the lines 24 and 26 into the condensate collecting tank can be reduced by the condensate return and steam recapture, likewise by 1-3 tons. The reduced amount of cooling water likewise leads to a reduction of the production costs.

Thus, this system constitutes a major advantage over the prior art.

Alternatively to the embodiment described with reference to FIG. 1, it is, however, also conceivable to undertake the device according to the configuration in FIG. 2. Here, the same parts or comparable components are labeled with the same reference numbers, and a repeated description is omitted.

Essentially, the configuration in FIG. 2 differs from the one in FIG. 1 in that the second pressure stage, with the second return line 33, the valve 32 and the pump 34 as well as the expansion valve 35 and the heat exchanger 38, is eliminated.

Instead, the condensate 22 in the first condensate separator 18 is compressed to 13 bar via the pump 28 and the first return line 25 and fed via the diffuser 30 into the second condensate separator 29. There, the liquid condensate collects in the lower region of the second condensate separator 29. Preferably, the exhaust air line 15 in the form of a tube heat exchanger (air-water) 39 is routed through this region in such a way that the heat of the exhaust air in the exhaust air line 15 that flows via the valve 43 and the line 41 in the helix 39 is transferred directly to the condensate 31 contained in the second condensate separator 29, and this condensate is vaporized in the second condensate separator. Then, the cooler exhaust air is supplied via the fan 16 to the aforementioned other heat recovery measures. The steam generated in the second condensate separator 29 is in turn fed back into the live steam network line 12 and thus into the live steam network via the backfeed line 36 with the valve 37 opened.

The advantage of this configuration is that the second pressure stage and its component can be omitted, as a result of which the investment costs can possibly be reduced. The structure of the device is thus mechanically much simpler. The disadvantage in this configuration compared to the configuration in FIG. 1 is, however, that the second condensate separator 29 must be provided at an uppermost position, i.e., directly under or on the roof of the machine hall that accommodates the paper machine. Such a tank, however, has large outside dimensions and a weight of between roughly 30-50 tons, as a result of which construction engineering problems can arise.

Otherwise, the second embodiment offers the same advantages as those explained with reference to FIG. 1.

In addition to the above-described embodiments, of course, other configurations and/or combinations of the embodiments are also conceivable. Thus, for example, the exhaust air from FIG. 1 that leaves the heat exchanger 38 could be subsequently routed through the second condensate separator 29 in order to already preheat the condensate there. Also, other exhaust heat sources from the paper machine could, for example, be used to preheat the condensate at one site or another (first or second condensate separator or another site). One skilled in the art recognizes, in view of the statements above, that different types of modifications and alterations of the illustrated embodiments are conceivable and feasible without departing from the basic idea of this invention, as it is defined in the following claims.

The invention claimed is:

1. Device for drying a tissue paper web, comprising:

a heatable cylinder;

a supply line that is connected to the cylinder for heating the cylinder with steam and that can be connected to a live steam network;

a condensate line for removing condensate from the cylinder;

a hot air hood on the outer periphery of the cylinder for flowing hot air in the direction of the outer periphery;

an exhaust air line that is connected to the hot air hood for removing exhaust air from the hot air hood; and a vaporization means for at least partial vaporization of the condensate with an energy transfer means in order to transfer energy of the exhaust air in the exhaust air line, downstream from the first pressure stage, to the condensate, a first pressure stage structured and arranged to compress condensate from the cylinder to essentially a first pressure level, the live steam network supplying at least two consumers with live steam at the first pressure level; and a backfeed line adapted be connected to the live steam network in order to feed the steam generated from the condensate back into the live steam network.

2. The device according to claim 1, wherein the vaporization means further comprise:

a second pressure stage structured and arranged to compress the condensate from the first pressure level to a second pressure level, the energy transfer means being formed by a heat exchanger that is located in the exhaust air line and that is downstream from the second pressure stage in order to heat the condensate that has been compressed to the second pressure level; and a third pressure stage structured and arranged to expand the heated condensate from the second pressure level to essentially the first pressure level and to vaporize it.

3. The device according to claim 2, further comprising:

a first condensate separator that is connected to the condensate line, a first return line that is connected to the first condensate separator, the first pressure stage being formed by a first pump in the first return line, a second condensate separator that is connected via a diffuser to the first return line and is heated via a tube exchanger with the hot exhaust air, the steam forming in the condensate separator being released to the steam network via the control valve.

4. The device according to claim 2, further comprising:

a second return line that is connected to the second condensate separator, the second pressure stage being formed by a second pump in the second return line and the heat exchanger being integrated in the second return line downstream from the second pump, the third pressure stage being formed by an expansion means located downstream from the heat exchanger, in the second return line, the second return line downstream from the expansion means being connected to the second condensate separator, the backfeed line being connected to the second condensate separator.

5. The device according to claim 2, wherein the second pressure level is in a range of 23-27 bar.

6. The device according to claim 1, wherein the first pressure level is in a range of 10-15 bar.

7. The device according to claim 1, wherein the energy transfer means comprise a condensate separator though which the exhaust air line runs.

8. The device according to claim 1, wherein the hot air hood is structured and arranged to flow hot air with a temperature of more than 530° C. in the direction of the outer periphery.

9. Method for steam recapture in the drying of a tissue paper web with a cylinder that is fed from a live steam network and with a hot air hood that flows hot air onto the tissue paper web, comprising the steps:

removing condensate from the cylinder;

heating the condensate by heat exchange with exhaust air from the hot air hood;

vaporizing the condensate;

compressing the condensate to a first pressure level essentially corresponding to that of the live steam network; and feeding generated steam into the live steam network.

10. The method according to claim 9, wherein the condensate, after compression to the first pressure level and before heating the condensate with exhaust air from the hot air hood, is compressed to a second pressure level, and wherein the condensate for vaporization, after heating the condensate with exhaust air from the hot air hood, is depressurized to the first pressure level.

11. The method according to claim 10, wherein the second pressure level is in a range of 23-27 bar.

12. The method according to claim 11, wherein the second pressure level is in a range of 24-26 bar, and the first pressure level is in a range of 13-14 bar.

13. The method according to claim 12, wherein the second pressure level is 25 bar, and the first pressure level is 13 bar.

14. The method according to claim 9, wherein the first pressure level is in a range of 10-15 bar.

15. The method according to claim 9, wherein the exhaust air has a temperature of more than 350° C.

* * * * *